US005503075A

United States Patent [19]

Matsuo et al.

[11] Patent Number: 5,503,075

[45] Date of Patent: Apr. 2, 1996

[54] IMAGE TRANSFER APPARATUS AND METHOD FOR EJECTING IMAGE RECEPTOR

[75] Inventors: Masaaki Matsuo; Takayuki Kimura, both of Tokyo, Japan

[73] Assignee: Toyo Ink Manufacturing Co., Ltd., Tokyo, Japan

[21] Appl. No.: 371,872

[22] Filed: Jan. 12, 1995

Related U.S. Application Data

[62] Division of Ser. No. 157,201, Apr. 19, 1994, Pat. No. 5,402,727.

[30] Foreign Application Priority Data

Apr. 13, 1992 [JP] Japan ..... 4-119675
Apr. 13, 1992 [JP] Japan ..... 4-119677

[51] Int. Cl.[6] ..... B41F 27/06

[52] U.S. Cl. ..... 101/477; 101/216; 101/415.1

[58] Field of Search ..... 101/378, 382.1, 101/415.1, DIG. 36, 477, 216, 114, 116, 117, 118, 141, 142, 479; 271/307, 308

[56] References Cited

U.S. PATENT DOCUMENTS 3,874,290 4/1975 Suzuki .
4,339,293 7/1982 Takahashi et al. .
4,846,057 7/1989 Endo et al. .
5,035,175 7/1991 Takita et al. .
5,048,416 9/1991 Iijima .
5,090,310 2/1992 Motoe .
5,111,744 5/1992 Wieland ..... 101/415.1
5,323,699 6/1994 Motoe .

FOREIGN PATENT DOCUMENTS 0216350 4/1987 European Pat. Off. .
0350195 1/1990 European Pat. Off. .
2242398 10/1991 United Kingdom .

*Primary Examiner*—Ren Yan
*Attorney, Agent, or Firm*—Wenderoth, Lind & Ponack

[57] ABSTRACT

An image transfer apparatus has a platen to which an image-forming material is to be attached and a transfer cylinder 1 to which an image receptor is to be attached. The apparatus is for transferring an image formed in a photosensitive layer of an image-forming material to an image receptor by the introduction of the image-forming material and the image receptor into a nip formed by the platen and the transfer cylinder. The apparatus has an image receptor attaching the apparatus having an image receptor attaching device comprising a device for holding the top end side of the image receptor to a transfer cylinder surface along the entire width of the image receptor and a device for holding the bottom end side of the image receptor to a transfer cylinder surface along the entire width of the image receptor. The device for holding the bottom end side comprises a holder and a holder seat for holding the image receptor, provided in a partial cut-off portion of a surface of the transfer cylinder and in an axial-length direction of the transfer cylinder. A bar is provided for pressing the image receptor to the transfer cylinder side in the cut-off portion between the holder seat and a surface of the transfer cylinder. The image receptor is rejected by the pressing bar.

10 Claims, 4 Drawing Sheets

IMAGE TRANSFER APPARATUS AND METHOD FOR EJECTING IMAGE RECEPTOR

This is a division of U.S. application Ser. No. 08/157201, filed on Apr. 19, 1994, now U.S. Pat. No. 5,402,727.

TECHNICAL FIELD

The present invention relates to an image transfer apparatus and a method for ejecting an image receptor from the apparatus. More specifically, it relates to an image transfer apparatus having an image receptor attaching device with which an image receptor can be attached without causing undulation- and curling-induced folding of the image receptor when attaching it and without causing wrinkle-induced defective attaching of the image receptor, and a method for ejecting the image receptor from a transfer cylinder without impairing an image transferred to the image receptor.

TECHNICAL BACKGROUND

A single-color or multi-color prepress proof suitable for proof printing, etc., has recently been increasingly produced. The prepress proof is produced by imagewise exposing an image-forming material comprising a substrate and a photosensitive layer formed on one surface of the substrate and then transferring an image to an image receptor, such as paper, under heat, generally around 100° C. The image-forming material is formed of a substrate, a photosensitive layer formed on one surface of the substrate and a protection layer. As the substrate and the protection layer, a thin film or sheet formed from a material such as cellulose acetate, polystyrene, polyvinyl chloride or polyethylene terephthalate is used. As the image receptor, a properly selected printing sheet such as paper or a film is used.

As an apparatus for preparing the above prepress proof, generally, there has been proposed an image-transfer apparatus having a platen to which an image-forming material is to be attached and a transfer cylinder to which an image receptor is to be attached. The platen and the transfer cylinder are brought into contact so that a photosensitive layer of the image-forming material and an image receptor are brought into contact with each other under pressure to transfer an image formed on the photosensitive layer to the image receptor in a nip portion formed by the platen and the transfer cylinder. The image receptor, such as paper, is preliminarily heated, and the image formed on the photosensitive layer of the above image-forming material is transferred to the paper by brining the photosensitive layer into contact therewith under pressure, whereby the transfer of the image, proceeds smoothly to give an aesthetically fine printed sheet. Generally, therefore, a means for heating the surface of the transfer cylinder at a proper temperature, e.g., around 100° C., is provided within the transfer cylinder to which the image receptor is to be attached.

The image receptor used in the present invention, such as paper, has the property of undergoing curling or undulation under heat. Therefore, the image receptor is liable to easily curl or undulate when it is brought into contact with the hot transfer cylinder surface. For holding the image receptor with one set of a holder and a holder seat extending in the axial-length direction of the transfer cylinder there is conventionally used a device for holding the bottom end side of the image receptor, with the image receptor is inserted into a narrow gap provided between the holder and the holder seat so that the portion of the image receptor which is to be held by the holder undergoes curling, undulation and shrinkage. It is therefore difficult to hold the image receptor with the holder firmly, and the attaching of the image receptor is liable to be defective. Further, it has not been possible to detect whether the image receptor is firmly attached by means of a device for attaching its top end side and a device for attaching its bottom end side in case of the above defective attaching. It has therefore been necessary to press the bottom end side of the image receptor manually and uniformly to a cut-off portion between the transfer cylinder surface and the holder before the bottom end side is held by the holder and holder seat of the device (also to be referred to as "clamp" hereinafter) for holding the bottom end side. Further, the transfer cylinder is heated for heating the image receptor at a proper temperature, e.g., around 100° C. In this case, the hand is likely to touch the transfer cylinder surface often when the image receptor is attached to the transfer cylinder surface. There is therefore a safety problem. There is also another problem in that manually pressing the bottom end side of the image receptor to the cut-off portion between the transfer cylinder surface and the holder seat increases the number of steps and requires additional time in the transfer operation.

Further, since the transfer cylinder has a relatively high temperature, there is a risk of the hand being burned when the image receptor is taken out from the transfer cylinder. There is another risk of the fingers being caught in the means for holding the image receptor to the transfer cylinder, such as a clamp. Moreover, when the image receptor is manually ejected, it means an additional step is required, and the time required for the transfer operation increases.

As an image receptor attaching means, it has been hitherto strongly desired to develop an image receptor holding device and a method for ejecting the image receptor from the transfer cylinder, with which a soft sheet-like substance such as the image receptor can be attached and detached easily and the image receptor can be held without causing a failure in attaching and without producing a defective print product. However, no device has yet been developed which can satisfy the above requirements.

It is therefore an object of the present invention to provide an image transfer apparatus for producing a prepress proof which has an image receptor attaching device with which a soft sheet-like substance such as the image receptor can be easily attached and detached and the image receptor can be attached while keeping the hand almost away from the transfer cylinder surface.

It is another object of the present invention to provide a method for ejecting the image receptor which permits the ejection of the image receptor from the transfer cylinder while keeping the hand almost away from the transfer cylinder and without impairing the quality of the image transfer product.

DISCLOSURE OF THE INVENTION

The present invention provides an image receptor attaching device for an image transfer apparatus having a platen to which an image-forming material is to be attached and a transfer cylinder to which an image receptor is to be attached. The apparatus is for transferring an image formed in a photosensitive layer of an image-forming material to an image receptor by the introduction of the image-forming material and the image receptor into a nip formed by the platen and the transfer cylinder.

The image receptor attaching device comprises a device for holding the top end side of the image receptor to a transfer cylinder surface along the entire width of the image receptor and a device for holding the bottom end side of the image receptor to a transfer cylinder surface along the entire width of the image receptor.

The device for holding the bottom end side comprises a holder and a holder seat for holding the image receptor, which are provided in a partial cut-off portion of a surface of the transfer cylinder and in an axial-length direction of the transfer cylinder. A bar for pressing the image receptor to the transfer cylinder side is provided in the cut-off portion between the holder seat and a surface of the transfer cylinder.

Further, an image transfer method uses an image transfer apparatus having a platen to which an image-forming material is to be attached, a transfer cylinder to which the image receptor is to be attached, a drawing roller for bringing the image receptor into close contact with a surface of the transfer cylinder, a bar which can be inserted in a partial cut-off portion between a means for holding the bottom end side of the image receptor in the partial cut-off portion of a surface of the transfer cylinder, and the surface of the transfer cylinder, and a tray on which the image receptor is to be placed. The method is for transferring an image formed in a photosensitive layer of an image-forming material to an image receptor by the introduction of the image-forming material and the image receptor into a nip formed by the platen and the transfer cylinder. The present invention provides a method for ejecting the image receptor which comprises steps a toe a. a step in which, after the transfer cylinder stops its rotation, the drawing roller comes in contact with a surface of the transfer cylinder and opens the means for holding the bottom end side of the image receptor, b. a step in which the drawing roller is allowed to rotate at a predetermined angle to draw out the image receptor from the means for holding the bottom end side and to close the means for holding the bottom end side, c. a step in which the bar is inserted in a partial cut-off portion between a means for holding the bottom end side of the image receptor and the surface of the transfer cylinder, d. a step in which the drawing roller is allowed to rotate to bring the image receptor outwardly in a radial direction of the transfer cylinder to a position above an upper surface of the bar, and e. a step in which the bar is moved outwardly in a radial direction of the transfer cylinder to move the top end portion of the image receptor outwardly in a radial direction of the transfer cylinder up to a position above the front end portion of the tray and then the drawing roller and the transfer cylinder are allowed to rotate to eject the image receptor onto the tray.

THE PREFERRED EMBODIMENTS OF THE PRESENT INVENTION

Figure 1:
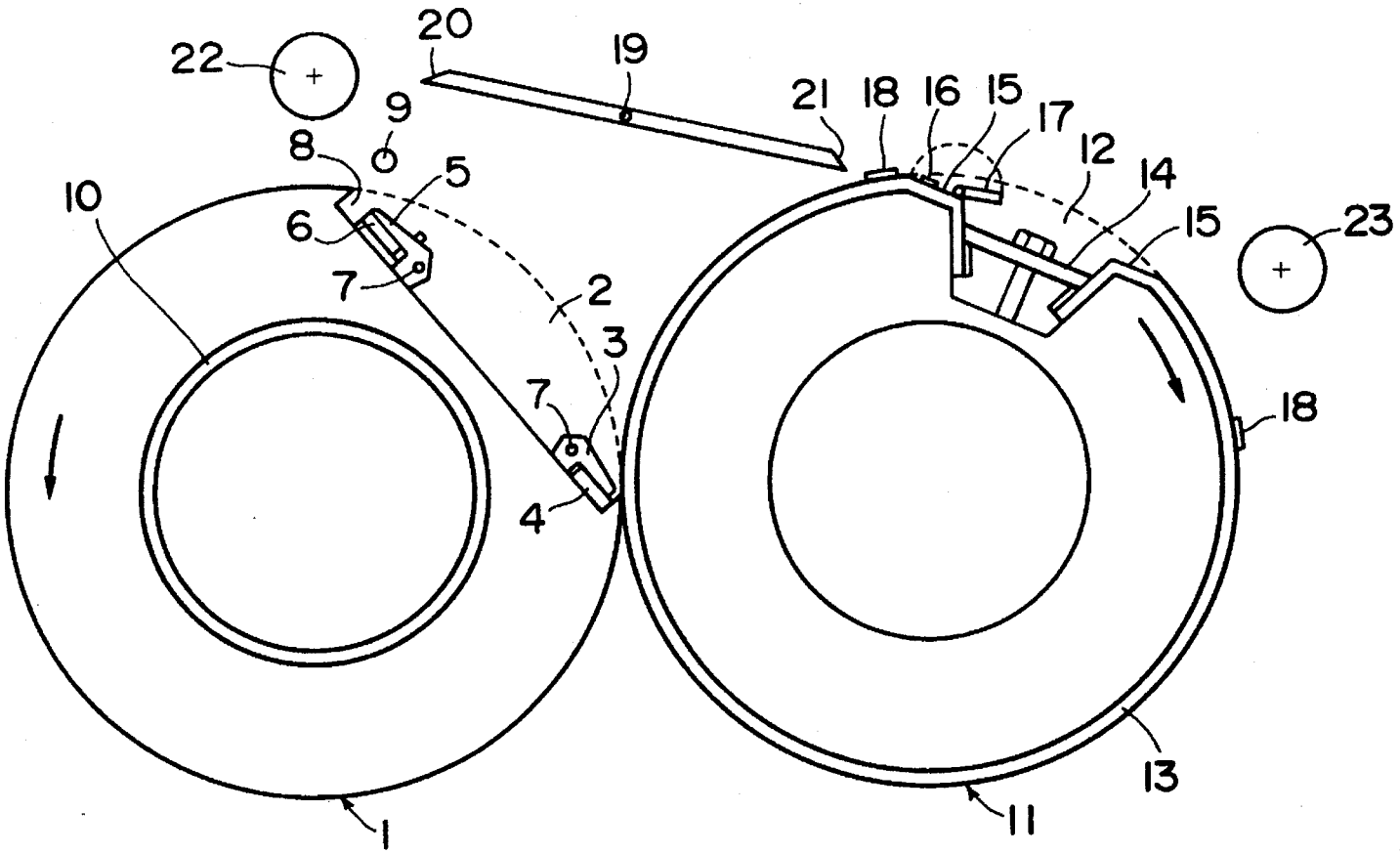
FIG. 1 is a schematic cross sectional view of an image transfer apparatus of the present invention having a platen which includes an image attaching apparatus and to which an image-forming material is to be attached and a transfer cylinder to which an image receptor such as paper is to be attached.

The present invention will be detailed hereinafter with reference to drawings. The constitution of the image transfer apparatus used in the present invention will be explained below with reference to FIG. 1. FIG. 1 is a schematic cross sectional view of an image transfer apparatus of the present invention having a platen which includes an image attaching apparatus and to which an image-forming material is to be attached and a transfer cylinder to which an image receptor such as paper is to be attached. A surface of a transfer cylinder 1 is provided with a partial cut-off portion 2. A clamp comprising a holder 3 and a holder seat 4, which together are means for attaching a top end side of an image receptor, and a clamp 27 comprising a holder 5 and a holder seat 6, which together are a means for attaching a bottom end side of the image receptor, are provided within the above partial cut-off portion 2. The holders 3 and 5 are provided with actuation shafts 7 on which the holders are actuated by a manual or electric actuation means. The holders are allowed to open and close by the rotation of the actuation means. A cut-off portion 8 between the clamp for holding the bottom end side and a transfer cylinder surface on the clamp side is provided with a pressing bar 9 which can be inserted in the cut-off portion 8 as required, i.e., can be moved in the radial direction of the transfer cylinder 1. The interior surface of the transfer cylinder is provided with a heating means 10. The pressing bar 9 can be preferably moved to a position apart from the transfer cylinder 1 when not used.

One embodiment of the constitution of a platen 11 will be explained with reference to FIG. 1. The platen 11 is provided with a partially cut-off portion 12. The surface of the platen 11 is wrapped with a blanket 13, and the blanket 13 is fixed within the partial cut-off portion with a blanket fixing means 14. The partial cut-off portion 12 has slope portions 15 extending between the partial cut-off portion and a platen surface (circumferential surface), and one slope portion is provided with a pin bar 16. The pin bar 16 has a height such that its top does not protrude over the circumferential surface of the platen 11. That is so the pin bar 16 or the surface of the transfer cylinder 1 are not damaged in the rotation of the platen 11 and the transfer cylinder 1. A magnet sheet 17 may be tiltably attached within the partial cut-off portion 12 for further securing the holding of an image-forming material to the platen surface. An adhesive tape 18 is provided on a platen surface near the slope portion 15 where the pin bar 16 is located, and another adhesive tape 18 is also provided on a platen surface near the other slope portion 15 of the partial cut-off portion. The magnet sheet 17 is not so wide as to reach the former adhesive tape 18 but is so wide as to cover the pin bar 16 when the magnet sheet is tilted to the pin bar 16 side.

Above the transfer cylinder 1 and the platen 11 there is preferably provided a tray 26 which can tilt with a fulcrum 19 as a center so that its end portions 20 and 21 can come close to the transfer cylinder or platen surface. An image-forming material or an image receptor is placed on the tray for facilitating the attaching or ejection of the image-forming material or the image receptor. A drawing roller 22 may be provided such that it can be in contact with the surface of the transfer cylinder 1 as required, and a drawing roller 23 may be provided such that it can be in contact with the surface of the platen 11 as required. The drawing roller 22 is effective for bringing the image receptor into close contact with the transfer cylinder surface and preventing the wrinkling and slackening of the image receptor when the image receptor is attached to the transfer cylinder surface. It is also effective for a step of ejecting the image receptor, to be described later. The drawing roller 23 is also effective in bringing the image-forming material into close contact with the platen surface and removing any wrinkle and slackening of the image-forming material when the image-forming material is attached to the platen surface.

The contact pressure of the drawing roller 22 on the transfer cylinder is properly adjusted with a spring (not shown), etc., or by its own weight. When the drawing roller 22 is not in operation, it is necessary to keep the drawing roller 22 apart from the transfer cylinder by means of a guide rail (not shown) provided on a frame of the image transfer apparatus in order to facilitate the attaching and detaching operations of the image receptor and the image transfer operation. The drawing roller 22 is preferably coated with a heat-resistant resin such as silicone rubber such that it has a proper friction force with the image receptor. The drawing roller to be provided near the surface of the platen 11 is preferably provided such that it has functions similar to the above.

Figure 2:
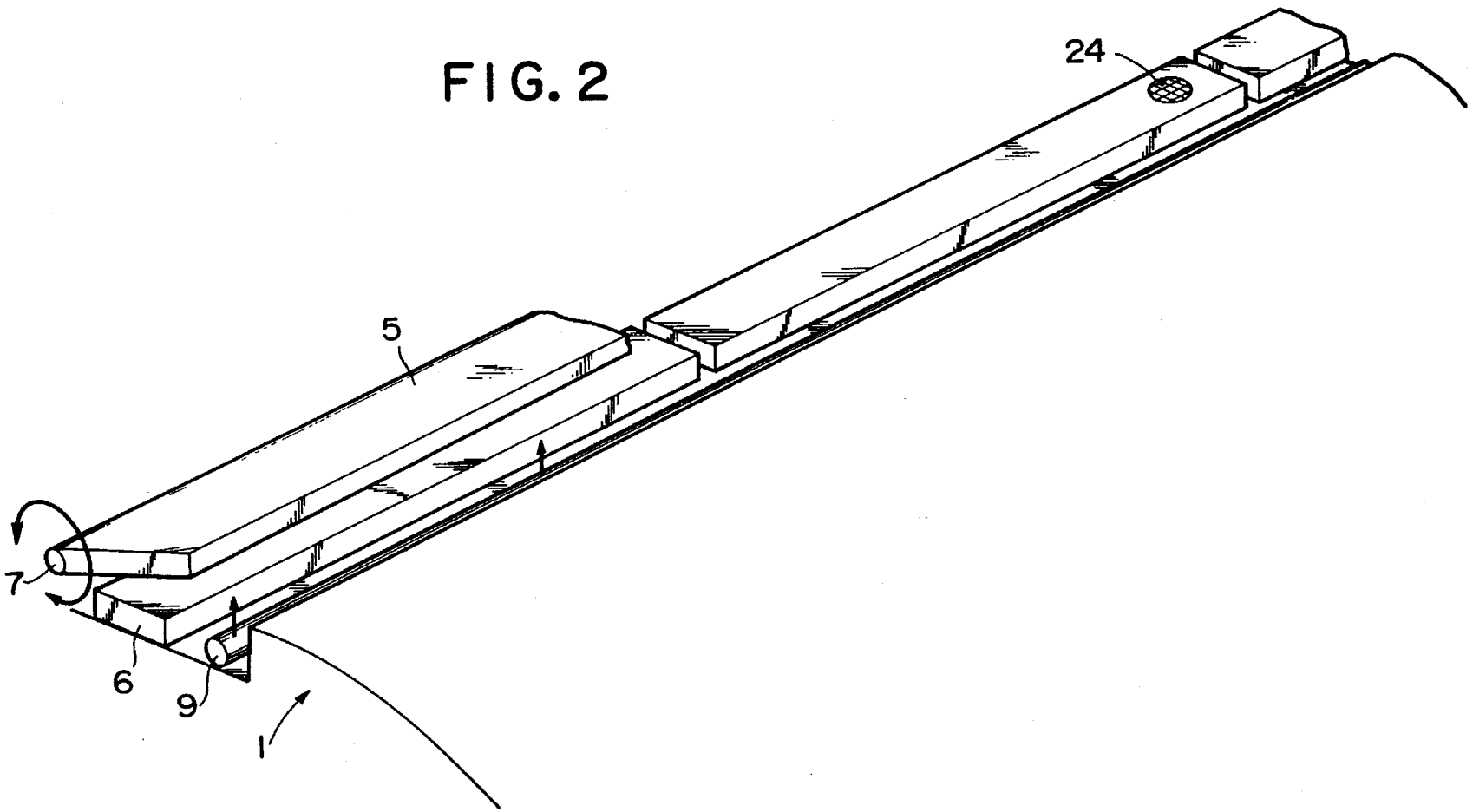
FIG. 2. is a perspective view of a device for holding the bottom end portion of the image receptor.

FIG. 2 shows an image receptor holding device for holding the bottom end side of the image receptor, comprising a bottom end side holder 5 and a bottom end side seat 6. A bar 9 for pressing the image receptor, such as paper, is placed such that it can be inserted in a cut-off portion 8 formed between the bottom end side holder seat 5 and the surface of the transfer cylinder 1 as required. A sensor 24, preferably a plurality of sensors, for sensing the image receptor may be provided on each of the bottom end holder seat 6 and the top end holder seat 4. The sensor is for determining the length of that portion of the image receptor that is inserted into the clamps. FIG. 1 shows the transfer cylinder 1 on the left hand side and the platen 11 on the right hand side, while FIG. 2 shows the device for holding the bottom end side of the image receptor where the transfer cylinder 1 is located on the right hand side and the platen 11 is located on the left hand side.

The function of the image transfer apparatus having the above image receptor attaching devices provided by the present invention will be explained hereinafter.

The image-forming material (not shown) is attached to the platen 11 by fitting the image-forming material to the pin bar 16 such that the pins of the pin bar are inserted into those holes of the image-forming material which correspond to the pins, pressing the image-forming material with the magnet sheet 17, rotating the platen 11 in an arrow direction while a proper tension is exerted on the image-forming material, and fixing the top end and bottom end sides of the image-forming material with the adhesive tapes 18.

The top end side of the image receptor (not shown) is held by the clamp comprising the holder 3 and holder seat 4 provided in the partial cut-off portion 2 of the transfer cylinder 1. A heating means 10 for heating the transfer cylinder surface to around 100° C. for keeping the image receptor warm in advance of the image transfer operation is provided within the transfer cylinder 1. For this reason, the image receptor is liable to curl and wrinkle due to its contact with the transfer cylinder surface when it is inserted into the clamp, and it is often difficult to firmly hold the image receptor with the clamp. Further, when the manual operation for securing the holding of the image receptor with the clamp is repeated near the clamp, the risk of the hand touching the transfer cylinder surface increases, which increasingly causes a safety problem.

The present invention, therefore, uses the image receptor pressing bar 9 to press the image receptor inwardly in a radial direction of the transfer cylinder 1 in the cut-off portion 8 between the holder seat 6 and the surface of the transfer cylinder 1. Therefore, the image receptor can be smoothly held by the clamp without a risk of the hand touching the transfer cylinder surface by pressing the image receptor by the inward movement of the pressing bar 9 in a radial direction of the transfer cylinder when the image receptor is inserted into the clamp and then closing the clamp. Further, the holder seat 6 is provided with an image receptor sensing sensor 24, whereby the position of the image receptor in the clamp can be firmly determined. As a result, troubles such as wrinkles caused on the image receptor due to a failure in holding the image receptor can be avoided.

After the top end side of the image receptor is held by the clamp, the transfer cylinder is preferably rotated in an arrow direction while the image receptor is kept in close contact with the transfer cylinder surface by means of the drawing roller 22, and then the image receptor is held by the bottom end side clamp. The top end side holder seat 4 may be provided with a sensor for sensing the image receptor.

Figure 3:
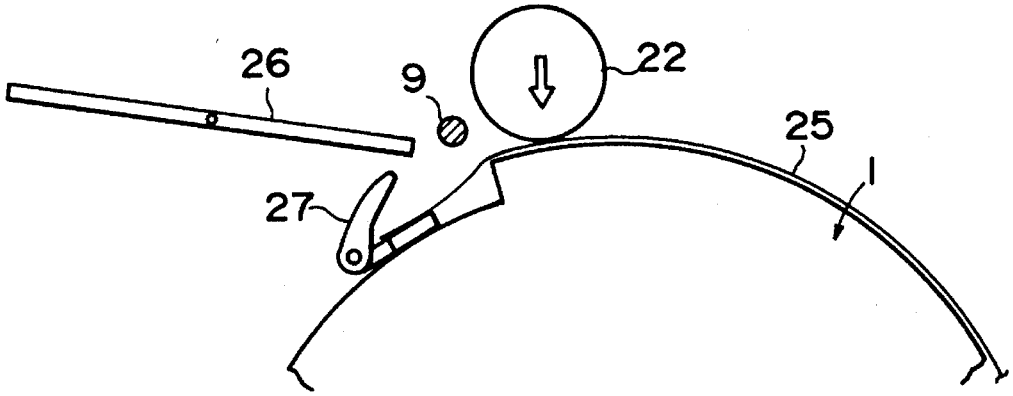
FIGS. 3 to 7 schematically show a method for ejecting the image receptor provided by the present invention.
Figure 4:
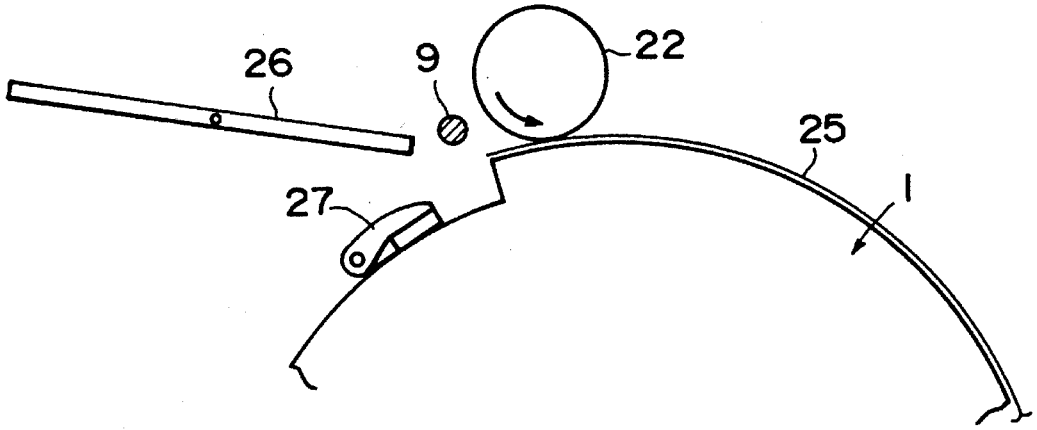
Figure 5:
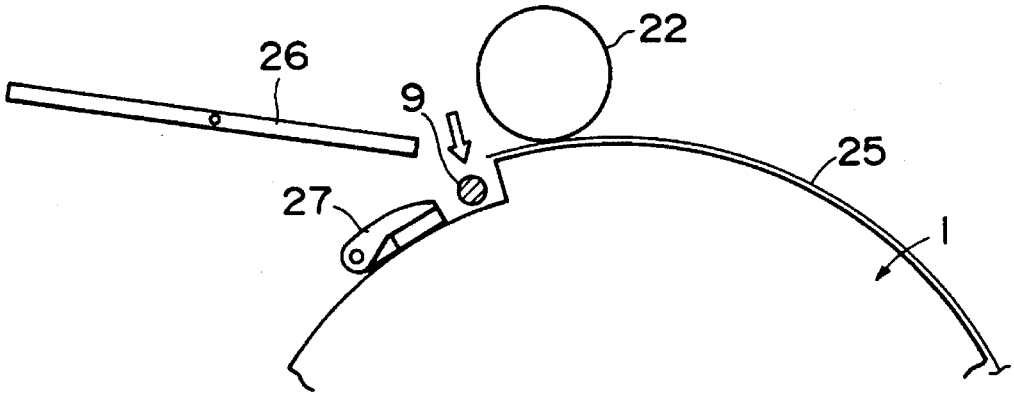
Figure 6:
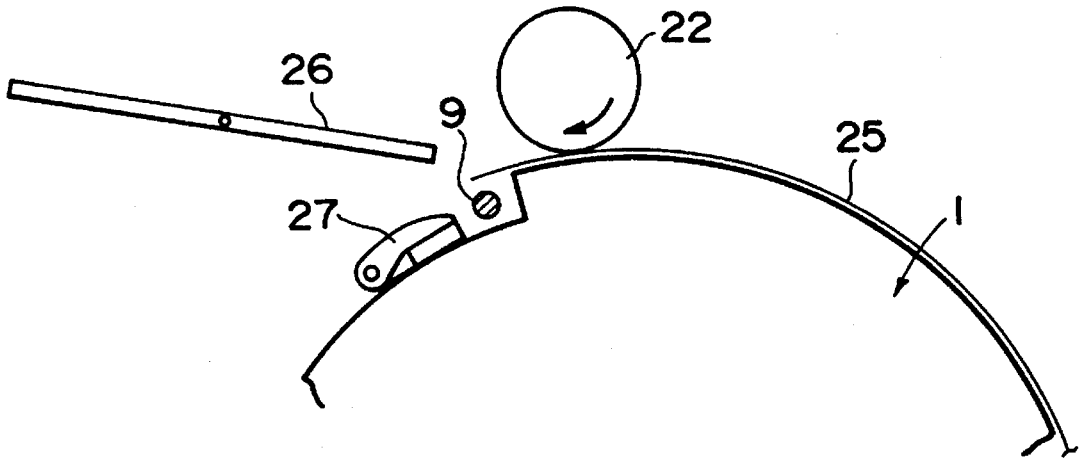
Figure 7:
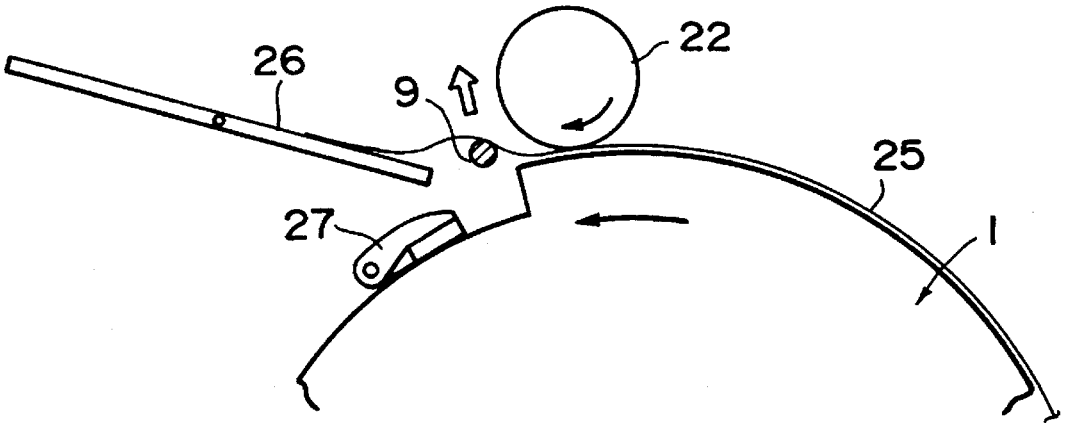

FIGS. 3 to 7 show steps a to e of the method for ejecting the image receptor provided by the present invention. FIGS. 3 to 7 shows the same arrangement of the transfer cylinder 1 and the platen 11 as that in FIG. 2, where the transfer cylinder 1 is placed on the right hand side and the platen 11 is placed on the left hand side. FIG. 3 shows a state in which the rotation of the transfer cylinder 1 is terminated and the drawing roller 22 is brought into contact with paper 25 on the transfer cylinder surface near the clamp (holder 5 and holder seat 6) after an image formed on the photosensitive layer of the image-forming material is transferred to the image receptor, such as paper 25, attached to the transfer cylinder 1 in a nip of the transfer cylinder 1 and the platen 11. In this case, the clamp is opened, and the paper 25 held with the clamp is drawn out. FIG. 4 shows a state in which the drawing roller is allowed to rotate a predetermined angle and the paper 25 is drawn apart from the clamp to a position near a nip formed by the drawing roller 22 and the transfer cylinder 1. After the paper 25 is drawn apart from the clamp, the clamp is closed. FIG. 5 shows a state in which the pressing bar 9 is inserted in the partial cut-off portion between the clamp and the transfer cylinder surface. FIG. 6 shows a state in which the drawing roller 22 is allowed to rotate and the paper 25 is allowed to reach a position above the pressing bar 9. FIG. 7 shows a state in which the paper is ejected onto the tray 26 by allowing the front end portion of the tray 26 to come close to a position near the surface of the transfer cylinder 1, allowing the pressing bar 9 to move outwardly in the radial direction of the transfer cylinder to a position above the front end portion of the tray, and then allowing the drawing roller 22 and the transfer cylinder 1 to rotate (in the direction of an arrow shown in FIG. 7).

The tray 26 may be provided such that its front end portion can come close to the surface of the transfer cylinder 1 as required to eject the image receptor onto the tray in a position near to the surface of the transfer cylinder 1. The bottom end side clamp (holder 3 and holder seat 4) is opened to draw out the held paper 25 when it comes close to the drawing roller 22 as the transfer cylinder 1 is allowed to rotate. The clamp may be controlled such that it is opened when it reaches a predetermined position, or it may be manually opened.

According to the present invention, there is provided an image receptor attaching device which is free from risks caused by heat, since the operation for attaching the image receptor can be carried out while keeping the hand apart from the hot surface of the transfer cylinder or the clamp. Further, there is provided an image receptor attaching device which is free from risks of the hand being caught in a machine in a rotation operation, which facilitates the attaching of the image receptor and which serves to decrease the time required for the transfer image production.

Further, according to the present invention, there is provided a method for ejecting the transfer image product from the transfer cylinder without impairing the product quality. There is also provided a method for automatically ejecting paper from the transfer cylinder while keeping the hand away from the hot transfer cylinder. There is further provided a method for ejecting the image receptor which can decrease the time required for the image transfer operation and can decrease the number of steps.

We claim:

1. A transfer cylinder arrangement in an image transfer apparatus comprising a platen and a transfer cylinder for transferring an image from a photosensitive layer of an image-forming material on the platen to an image receptor on the transfer cylinder by introducing the image-forming material and the image receptor into a nip formed by the platen and the transfer cylinder, said transfer cylinder arrangement comprising:

said transfer cylinder having an axial direction, a radial direction, a first surface with a partial cut-off portion therein and a second surface at said partial cut-off portion;

an image receptor attaching device on said transfer cylinder, said image receptor attaching device comprising a first device for holding the top end of the image receptor along its entire width and a second device for holding the bottom end of the image receptor along its entire width such that the image receptor can be held to said first surface of said transfer cylinder, wherein said second device for holding the bottom end of the image receptor comprises a holder and a holder seat for holding the image receptor, said holder and said holder seat being located in said partial cut-off portion of said first surface of said transfer cylinder and extending in said axial direction of said transfer cylinder; and a bar being movably mounted, said bar being moved in said radial direction of said transfer cylinder in said cut-off portion thereof to and from a position in between said holder seat and said second surface of said transfer cylinder for moving the image receptor in said radial direction of said transfer cylinder.

2. The transfer cylinder arrangement of claim 1, wherein said holder seat of said second device comprises at least one sensor for sensing a position of the image receptor.

3. The transfer cylinder arrangement of claim 1, wherein said first device comprises a holder seat having at least one sensor for sensing a position of the image receptor and a holder for holding the image receptor.

4. The transfer cylinder of claim 1, wherein said partial cut-off portion of said transfer cylinder is defined by surfaces on said transfer cylinder having a smaller radius than said first surface, said surfaces comprising said second surface, and wherein a space between said holder seat of said second device and said second surface is larger than said bar as seen in an axial cross-section of said transfer cylinder.

5. The transfer cylinder of claim 1, wherein said position between said holder seat of said second device and said second surface is located between the image receptor and said transfer cylinder when the image receptor is held on said transfer cylinder by said second device of said image receptor attaching device.

6. A transfer cylinder arrangement in an image transfer apparatus comprising a platen and a transfer cylinder for transferring an image from a photosensitive layer of an image-forming material on the platen to an image receptor on the transfer cylinder by introducing the image-forming material and the image receptor into a nip formed by the platen and the transfer cylinder, said transfer cylinder arrangement comprising:

said transfer cylinder having an axial direction, a radial direction, and a surface with a partial cut-off portion therein;

an image receptor attaching device on said transfer cylinder, said image receptor attaching device comprising a first device for holding the top end of the image receptor along its entire width and a second device for holding the bottom end of the image receptor along its entire width such that the image receptor is held to said first surface of said transfer cylinder, wherein said second device for holding the bottom end of the image receptor comprises a holder and a holder seat for holding the image receptor, said holder and said holder seat being located in said partial cut-off portion of said surface of said cylinder and extending in said axial direction of said transfer cylinder; and a bar means being movably mounted, said bar means being moved in said radial direction of said transfer cylinder in said cut-off portion thereof to and from a position adjacent to said holder seat of said second device for moving the image receptor in said radial direction of said transfer cylinder and away from said transfer cylinder.

7. The transfer cylinder arrangement of claim 6, wherein said holder seat of said second device comprises at least one sensor for sensing a position of the image receptor.

8. The transfer cylinder arrangement of claim 6, wherein said first device comprises a holder seat having at least one sensor for sensing a position of the image receptor and a holder for holding the image receptor.

9. The transfer cylinder of claim 6, wherein said partial cut-off portion of said transfer cylinder is defined by surfaces on said transfer cylinder having a smaller radius than said first surface, and said position being located at a radial distance smaller than the radius of said first surface.

10. The transfer cylinder of claim 6, wherein said position adjacent to said holder seat of said second device is located between the image receptor and said transfer cylinder when the image receptor is held on said transfer cylinder by said second device of said image receptor attaching device.

* * * * *